United States Patent [19]

Roeder

[11] 4,084,923

[45] Apr. 18, 1978

[54] DOUBLE-ACTING, DOWNHOLE PUMP ASSEMBLY

[76] Inventor: George K. Roeder, P.O. Box 4335, Odessa, Tex. 79760

[21] Appl. No.: 702,695

[22] Filed: Jul. 6, 1976

Related U.S. Application Data

[63] Continuation-in-part of Ser. No. 632,550, Nov. 7, 1975.

[51] Int. Cl.[2] ..... F04B 17/00; F04B 35/00; F04B 21/04

[52] U.S. Cl. ..... 417/393; 417/396; 417/404; 417/523

[58] Field of Search ..... 417/377, 393, 396, 404, 417/522, 523, 392; 91/325, 341 R, 341 A

[56] References Cited

U.S. PATENT DOCUMENTS

| | | | |
|---|---|---|---|
| 1,880,321 | 10/1932 | Jackson | 417/377 |
| 2,012,839 | 8/1935 | Turner | 417/403 |
| 2,307,566 | 1/1943 | Browne | 417/393 |
| 3,084,630 | 4/1963 | Massey | 417/523 |
| 3,517,741 | 6/1970 | Roeder | 417/404 |

FOREIGN PATENT DOCUMENTS

| | | | |
|---|---|---|---|
| 496,448 | 9/1953 | Canada | 417/392 |

*Primary Examiner*—William L. Freeh
*Assistant Examiner*—Thomas I. Ross
*Attorney, Agent, or Firm*—Marcus L. Bates

[57] ABSTRACT

A downhole, hydraulically actuated pump assembly of the free or fixed type which includes a control valve positioned above the engine, and a plurality of pistons connected together by a hollow connecting rod. The pistons are arranged to divide a production cylinder from an engine cylinder, so that the connecting rod is always placed in compression, thereby avoiding rod breakage. The hollow connecting rod is employed to supply power fluid to the lower engine, and the rod ends are arranged to have fluid pressure exerted thereagainst to improve the operation of the pump assembly.

The production pump divides the engine into an upper and lower engine assembly so that the upper engine strokes the pump in a downward direction, while the lower engine strokes the pump in an upward direction.

8 Claims, 7 Drawing Figures

DOUBLE-ACTING, DOWNHOLE PUMP ASSEMBLY

CROSS-REFERENCE TO OTHER APPLICATIONS

This application is a continuation-in-part of my copending application, Ser. No. 632,550, filed Nov. 17, 1975.

REFERENCE TO RELATED PATENTS

Roeder U.S. Pat. Nos. 3,453,963; 3,517,741; 3,625,288; 3,627,048; 3,650,640; 3,703,926; 3,865,516; and to the art cited therein.

BACKGROUND OF THE INVENTION

Pumps of both the fixed and free type often include a control valve means axially positioned above an engine and a production pump means, and it is not unusual for the engine chambers to be positioned at each extremity of the production pump means, as evidenced by my previous U.S. Pat. No. 3,650,640. However, in this particular fixed-typed pump, provisions must be made within the side wall of the pump housing for various fluid flow paths, as for example, from the valve means to the engine means, and consequently, the diameter of the pistons thereof are reduced a corresponding amount.

Some oil wells are extremely deep and small in diameter and require a slim pump for accommodation within the slim borehole. Some of these walls are high volume producers and require a high volume pump. Accordingly, the present invention provides an improvement over U.S. Pat. No. 3,650,640 by the provision of both a fixed and a free-type downhole pump assembly which eliminates the heretofore necessary internal flow passageways formed within the side wall of the production pump and engine housing. This improvement is brought about by a novel combination of flow passageways formed externally of the pump housing and other passageways formed within the reciprocating, centrally located, control rod of the pump assembly.

The present invention further provides a novel hydraulic pump assembly which operates in a manner to eliminate rod breakage by arranging the component parts thereof to always place the connecting rod in compression during both the up and down stroke.

The above combination of elements provide a multistage pump which can be assembled to employ any number of engine and production pistons to thereby increase the production rate, while at the same time lowering the pressure required of the power fluid.

SUMMARY OF THE INVENTION

This invention relates to both a free and fixed-type, hydraulically actuated, downhole pump apparatus for producing a well. The pump apparatus comprises an elongated housing having a valve assembly at the upper end thereof, a double-acting production pump located between spaced engine pistons, with part of the engine separating the pump from the valve assembly, and with the flow passageways to and from the pump and the engine being arranged respective to one another and to the piston chambers of the engine and pump, such that a connecting rod connects each of the pistons of both the pump and the engine end together. The connecting rod is placed in compression during each of the production strokes.

In one embodiment of the invention, power fluid enters a chamber at the uppermost end of the pump assembly. A hollow control rod extends from the chamber, down through the control valve means, where it is joined to each of the pistons. A lower marginal end of the rod continues into a rod balance cavity. The uppermost piston is forced to downstroke by hydraulic power fluid, while the lowermost piston is forced to upstroke by hydraulic power fluid, thereby placing the connecting rod in compression at all times during the up and down stroke. The opposed ends of the rod are subjected to hydraulic pressure during each stroke.

In another embodiment of the invention, five axially spaced pistons are connected to one another by a hollow connecting rod. The marginal ends of the rod are reciprocatingly received within a chamber so that fluid pressure is exerted against each terminal end of the connecting rod. The pistons each reciprocate within a cylinder, with there being two piston faces which downstroke the engine, two piston faces which upstroke the engine, and four piston chambers for producing fluid. The four production chambers separate the engine piston chambers from one another.

Therefore, a primary object of this invention is the provision of a hydraulically actuated pump assembly having the pistons and flow passageways thereof arranged respective to one another to enable multiple stages to be added thereto to thereby increase the rate of production.

Another object of the invention is the provision of a hydraulically actuated pump assembly having the pistons and flow passageways thereof arranged respective to one another so that the number of engine pistons can be increased respective to the number of production pistons to thereby lower the operating pressure required of the hydraulic power fluid which actuates the downhole pump.

A further object of this invention is the provision of a hydraulically actuated, downhole pump assembly which includes a plurality of production and engine pistons associated therewith and connected together by a connecting rod which is always maintained in compression during the upstroke and downstroke.

A still further object of this invention is the provision of a multi-stage, downhole, hydraulically actuated pump assembly having a plurality of pistons which may be arranged respective to one another and to flow passageways associated therewith so that additional engine and pump pistons can be included in order to increase the production rate of the pump assembly.

A still further object of this invention is the provision of a downhole, hydraulically actuated pump which utilizes a hollow connecting rod for conveying power fluid to the engine, and having two engines separated by the pump, and having the pistons thereof arranged in such a manner that the connecting rod located therebetween is always placed in compression.

These and other objects and advantages of the invention will become readily apparent to those skilled in the art upon reading the following detailed description and claims and by referring to the accompanying drawings.

The above objects are attained in accordance with the present invention by the provision of an apparatus which is fabricated in a manner substantially as described in the above abstract and summary.

DETAILED DESCRIPTION OF THE PREFERRED EMBODIMENTS

Figure 1:
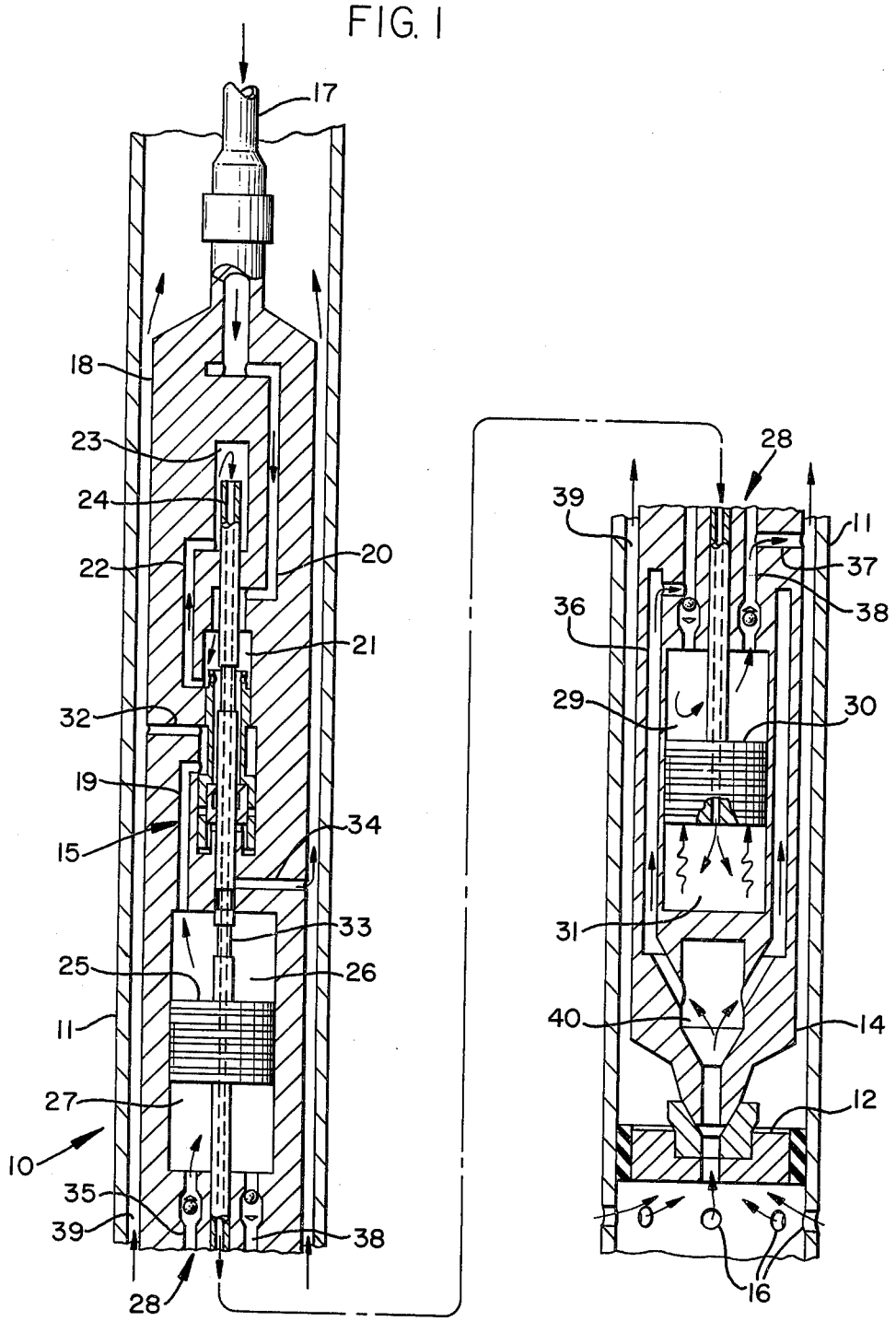
FIG. 1 is a fragmented, longitudinal, broken, part cross-sectional view of a downhole pump made in accordance with the present invention.

In FIG. 1, the numeral 10 generally indicates a downhole, hydraulically actuated pump assembly made in accordance with one of the embodiments of the present invention. A cased borehole 11 includes a packer device 12 having a suitable seat thereon for receiving the lower end 14 of the downhole pump assembly of the present invention. The details of the packer 12 and the seat are known to those skilled in the art.

The pump assembly includes a hydraulic control valve assembly 15, the details of which are more specifically discussed in my copending patent application, Ser. No. 632,550, filed Nov. 17, 1975, of which this patent application is a continuation-in-part. Perforations 16 are formed in the casing to provide a source of formation fluid for the pump, while a power oil string 17 conveys power oil downhole to the upper end 18 of the pump assembly.

Power oil flows down passageway 20 where it is available at chamber 21 for use by the valve assembly. The valve assembly controls the flow of fluid into and from passageways 19 and 22. Passageway 22 provides a source of fluid within a power fluid chamber 23. The upper marginal end of a hollow control rod 24 reciprocates within the before mentioned chamber and provides a source of power fluid which flows down through the interior of the control rod, through the valve assembly, and through a piston 25. The piston 25 reciprocates within a piston cylinder and divides the cylinder into an upper engine piston chamber 26 and a lower production piston chamber 27.

A production valve assembly 28 controls the flow of formation fluid into and from production piston chambers 27 and 29. Piston 30 is connected to the illustrated connecting rod and reciprocates within the illustrated lowermost cylinder, thereby dividing the cylinder into an upper production piston chamber 29 and a lower engine piston chamber 31.

Spent power fluid outlet passageway 32 is connected to the before mentioned control valve to enable the valve to alternately exhaust fluid from passageways 19 and 22. Flats 33 cooperate with passageway 34 to improve the operation of the control valve in a manner more specifically set forth in my previously filed patent application, Ser. No. 632,550, filed Nov. 17, 1975.

Passageway 35 of production valve assembly 28 provides for intake of formation fluid into piston chambers 27 and 29, and is flow connected to longitudinal passageway 36, which in turn is connected to the lower inlet end of the pump. Outlet passageway 37 alternately exhausts production fluid from production chambers 27 and 29 by means of a flow passageway 38. The last named passageway includes the illustrated check valves located therein in the usual manner.

Annulus 39 is formed between the main housing of the pump assembly and the casing, and receives fluid which the pump forces from the production inlet chamber 40 and through the production end of the pump.

Figure 2:
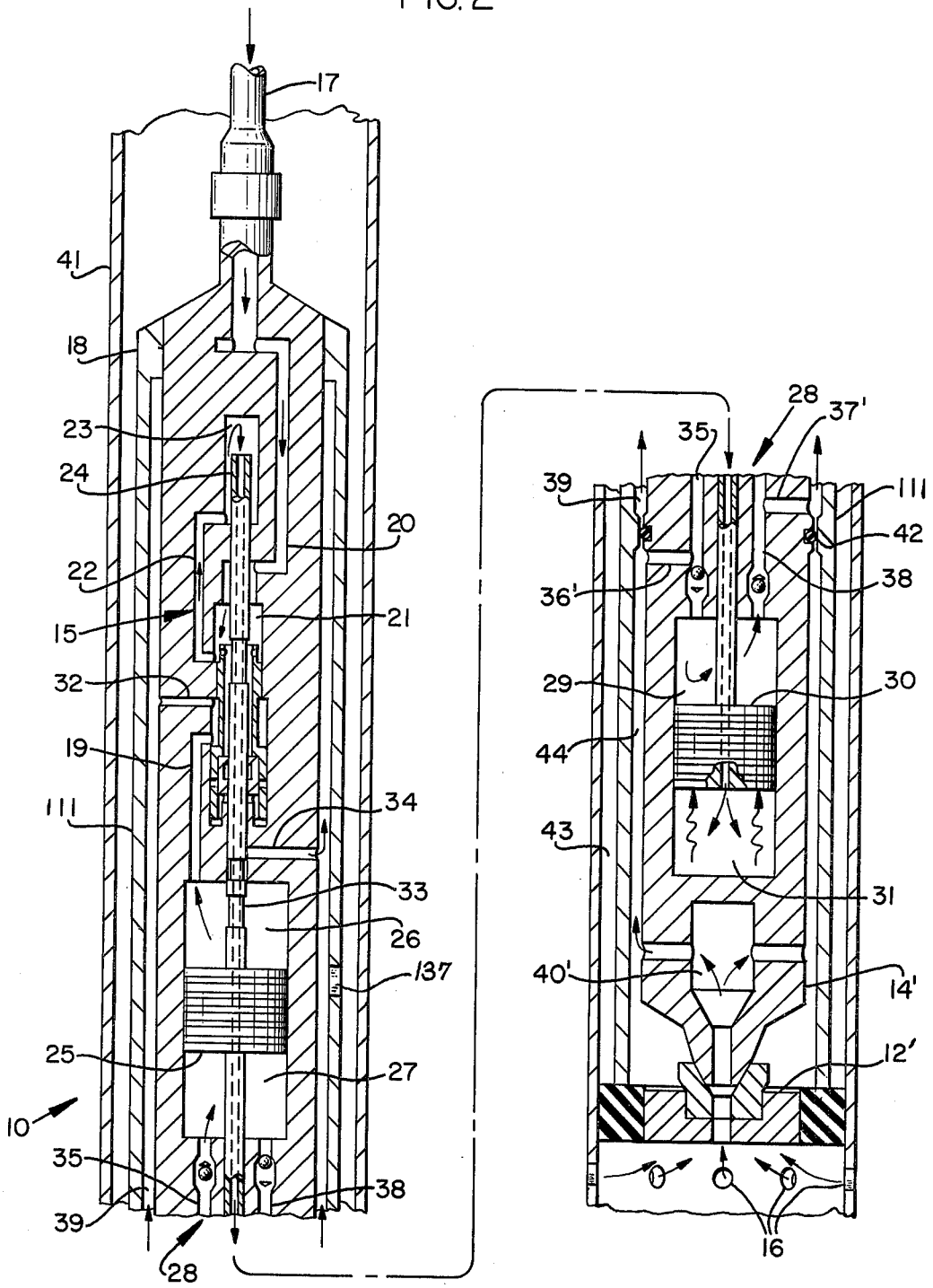
FIG. 2 is a fragmented, longitudinal, cross-sectional view of a fixed, downhole pump made in accordance with the present invention.

In FIG. 2 there is disclosed a modification of the pump apparatus seen in FIG. 1, with the before mentioned valve assembly 15, upper piston 25, and lower piston 30 being axially aligned and disposed within the pump assembly in the same before described manner of FIG. 1.

The borehole 41 is usually provided with the illustrated perforated casing, while a power oil tubing is concentrically arranged therewith. The lower marginal end of the pump and shroud 111 are provided with a circumferential seal at 42 so that production fluid must enter the illustrated casing perforations, flow through the shoe or seating assembly 12', into the lower pump inlet, where the formation fluid then enters chamber 40', exits at the illustrated radial ports, and enters the lower production annulus 44. The production pump is provided with an inlet 36' which provides the production valve assembly with formation fluid as in the before described manner of FIG. 1. The production pump forces the fluid to exit at 37' into an upper production annulus 39 so that produced and spent power fluid is forced through outlet 137 of the shroud and uphole to the surface of the ground. Accordingly, there is no requirement for the formation of an internal fluid flow passageway about the pistons 25 and 30 of the embodiment of FIG. 2.

Figure 3:
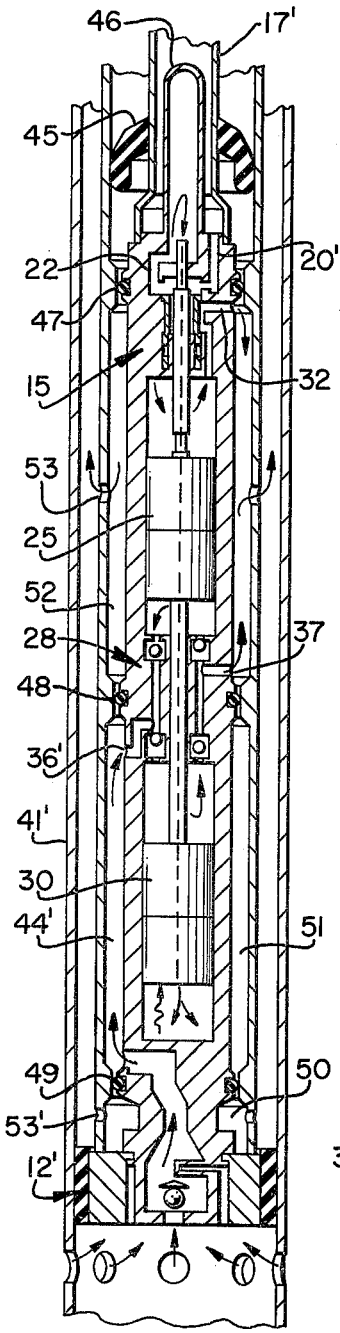
FIG. 3 is a part cross-sectional, fragmented illustration of a downhole pump of the free type made in accordance with the present invention.

In the embodiment of FIG. 3 there is disclosed a free-type pump assembly which is a modification of the disclosed embodiment of FIGS. 1 and 2. As seen in FIG. 3, the power fluid control valve 15, production fluid valves 28, and the upper and lower pistons 25 and 30 are arranged respective to one another as in the before described embodiments of FIGS. 1 and 2. The free pump of FIG. 3 is provided with a packer nose 45, the details of which are more fully set forth in my previous U.S. Pat. No. 3,517,741. Tubing 17' extends a short distance above chamber 46 and provides a fluid inlet, as well as a means by which the entire pump assembly can be "fished" from the borehole if misfortune occurs and such an expedient is required.

Seal means 47, 48, and 49 circumferentially extend about the pump in the same manner taught in my last named issued patent. The seal means cooperate with the pump and the production tubing to form spaced annular chambers 50, 51, and 52, while outlet ports 53 and 53' provide a flow path along which produced fluid admixed with spent power fluid can flow into the casing annulus and uphole to the surface of the ground.

The valve assembly of the present invention is set forth in greater detail in my co-pending patent application Ser. No. 632,550, filed Nov. 17, 1975, and in my issued U.S. Pat. Nos. 3,915,595; 3,957,400; and 3,865,516. Those skilled in the art will appreciate that reciprocal movement of the hollow control rod 24 shifts the traveling valve element, or sleeve, to alternately connect the first passageway 33 and second passageway 24' to the exhaust port 32 and to the source of power fluid at 21, thereby reciprocating the engine pistons.

The valve element of the valve assembly shifts as the illustrated flat (located within chamber 26 in FIG. 4) moves up above the valve element thereby allowing power oil to be exerted under the valve element, whereupon flow occurs from power fluid chamber 21, through the annulus located between the valve element and the hollow control rod, to the large area under the element, causing the valve element to shift up because of the difference in the areas at each end thereof.

When the valve element shifts up, one of the first and second passageways 22' is joined to the exhaust port 32 by means of the illustrated medial undercut area located about the valve element. This action permits power oil to exhaust from the area below the lower piston 30', up through the hollow rod, into upper fluid chamber 23, through passageway 22', across the undercut area of the valve element, and through the exhaust port 32.

Power oil is simultaneously supplied to chamber 26 by means of the lower port located in the traveling valve element which has been brought into alignment with the inlet to passageway 33, thereby supplying oil from the annulus located between the traveling valve element and the hollow control rod. Hence, flow occurs through the ports located within the traveling valve element, into the inlet of passageway 33, through the passageway and into the chamber 26 above the piston 25 thereby driving the piston in a downward direction whereupon the valve element then shifts to the alternate position and the relationship between the first and second passageways and the power oil inlet and exhaust port again reverses, and power fluid then flows in the illustrated manner of FIG. 4.

Figure 4:
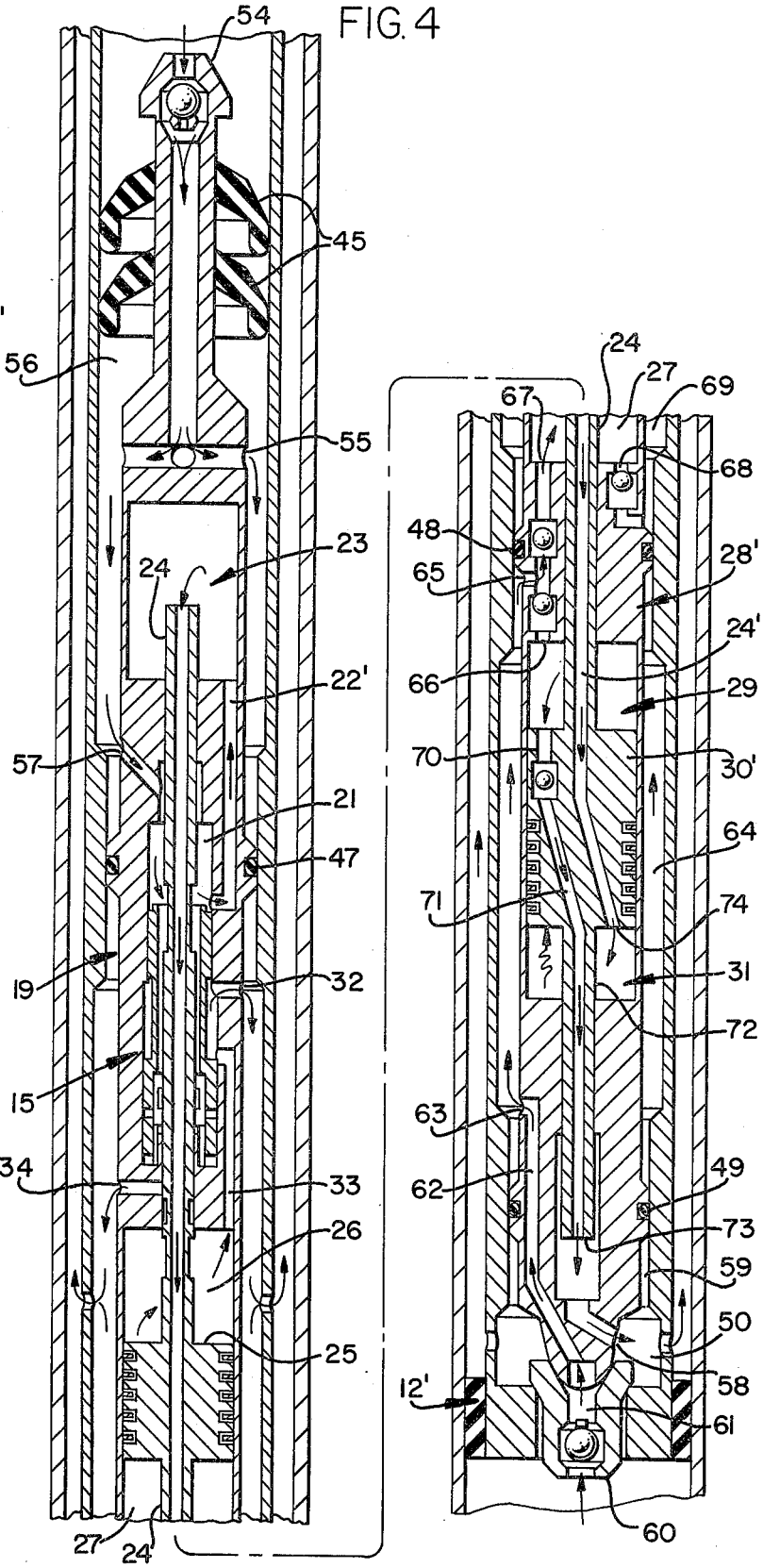
FIG. 4 is a fragmentary, longitudinal, part cross-sectional representation of another embodiment of the present invention.

FIG. 4 represents still another embodiment of the present invention and includes the before mentioned control valve assembly 15, an uppermost piston 25 arranged respective to one another in a manner similar to the foregoing embodiments of the invention. The packer nose assembly is provided with a fishing neck 54 which conducts power fluid therethrough, out of radial ports 55, into the annular chamber 56, and to the power fluid intake port 57; so that a source of power fluid can be made available for the control valve at the before mentioned chamber 21.

Produced fluid from outlet 58 is received within a lower annular chamber 50 and flows through the tubing ports associated therewith and into the casing annulus.

Foot valve 60 sealingly receives the lower extremity of the pump assembly so that formation fluid is made available at 61 where it flows up through the passageway 62, through port 63, annulus 64, production valve intake 65, where the formation fluid enters the spaced production chambers at 66 and 67. Fluid is pumped from the chamber 27, through the check valve assembly at 68, and enters annulus 69, where the fluid then flows through the illustrated exhaust port formed in the tubing and co-mingles with fluid flowing up the casing annulus.

Piston 30' is provided with a production port 70, which includes the illustrated traveling check valve therein so that produced fluid can flow from chamber 29, through passageway 71, and into the lower hollow balance tube 72. The balance tube has a lower terminal end 73 reciprocatingly received within the illustrated balance chamber, and is therefore always subjected to the hydrostatic head of the wellbore.

Piston 30° is also provided with a power fluid outlet 74 through which power fluid and spent power fluid can flow into and out of piston chamber 31 in order to upstroke the piston while the rod 24 is placed in further compression.

Figure 5:
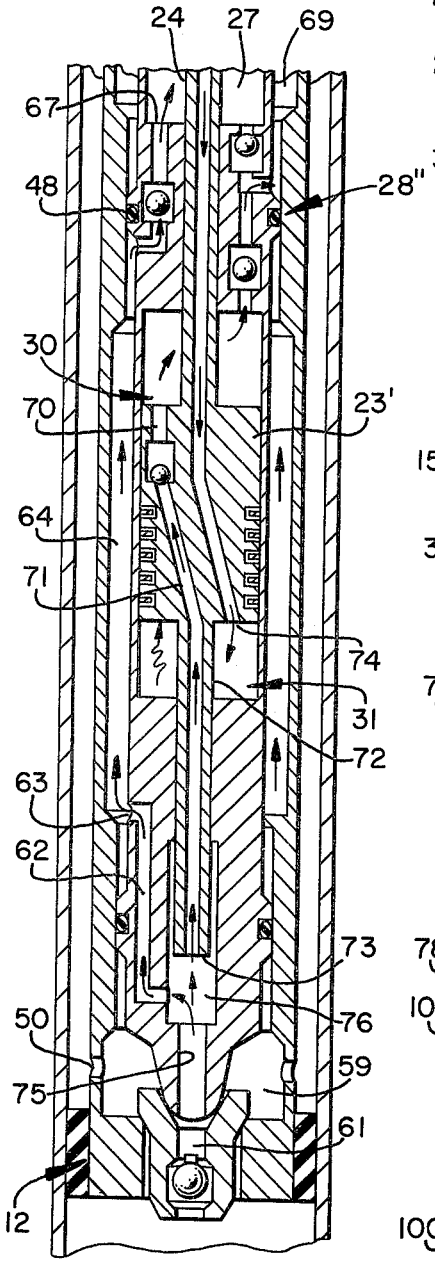
FIG. 5 is a fragmentary, longitudinal, part cross-sectional representation of a modification of the pump assembly disclosed in FIG. 4.

FIG. 5 sets forth a modification of the pump assembly disclosed in FIG. 4. In FIG. 5 the remainder of the pump assembly located above the production valve 28'' is preferably made identical to the upper part of the pump assembly disclosed in FIG. 4; and accordingly, the details thereof have not been included therein. The pump inlet 75 is connected to a balance chamber 76 which reciprocatingly receives the marginal lower end of a balance tube 73. Formation fluid flows through the packer apparatus 12, into the chamber 76, where flow can then occur along flow path 62, through the valve assembly 28'', and into chamber 27. Fluid can also enter the end 73 of the hollow balance tube 72, where it flows through piston passageway 71 and into the production piston chamber 30.

Fluid exhausts from both production chambers 27 and 30, through the valve 28'', and into the annulus 69, where it is then free to flow uphole, along with the spent power fluid, to the surface of the earth.

Figure 6:
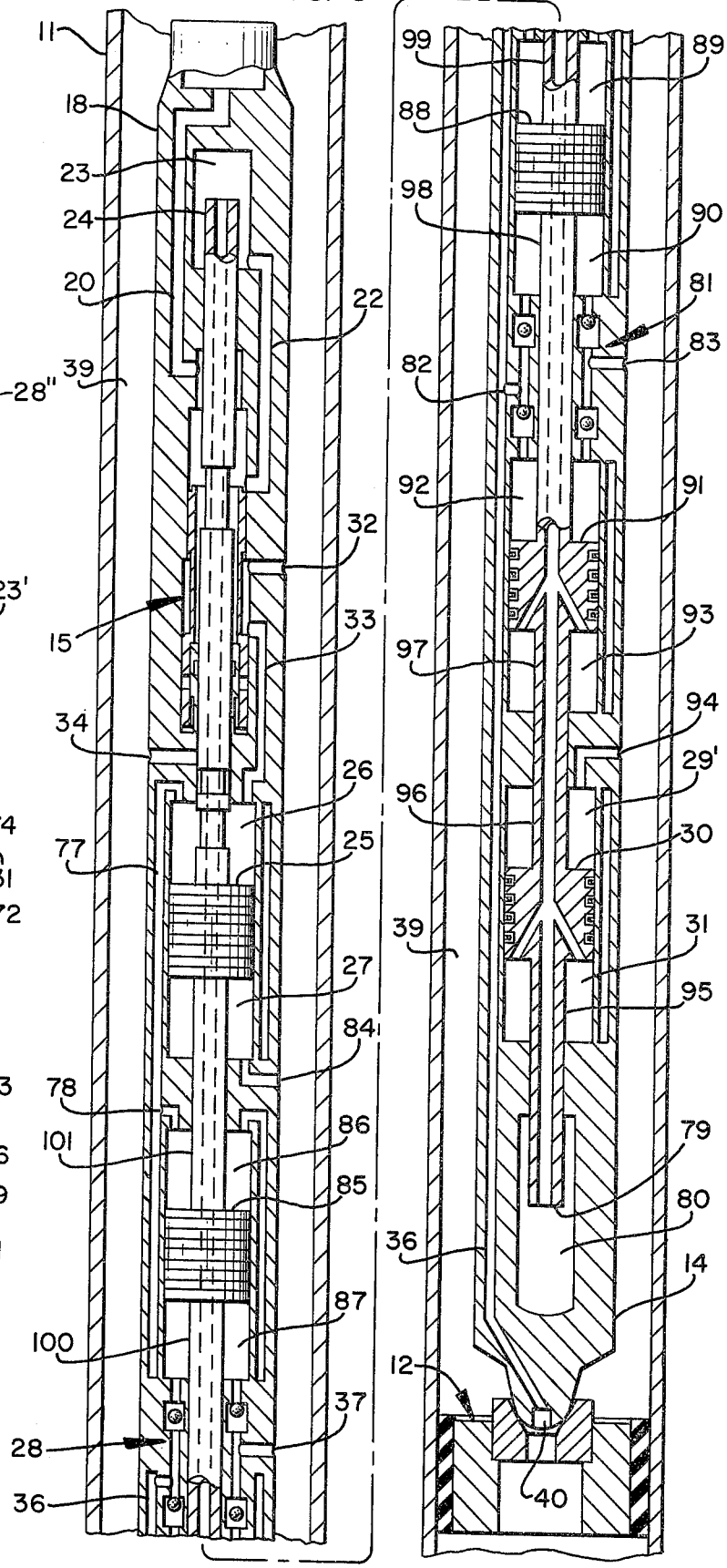
FIG. 6 is a fragmentary, longitudinal, part cross-sectional representation of still another embodiment of the present invention; and, FIG. 7 is a fragmentary, longitudinal, part cross-sectional representation of a modification of the pump assembly disclosed in FIG. 6.
Figure 7:
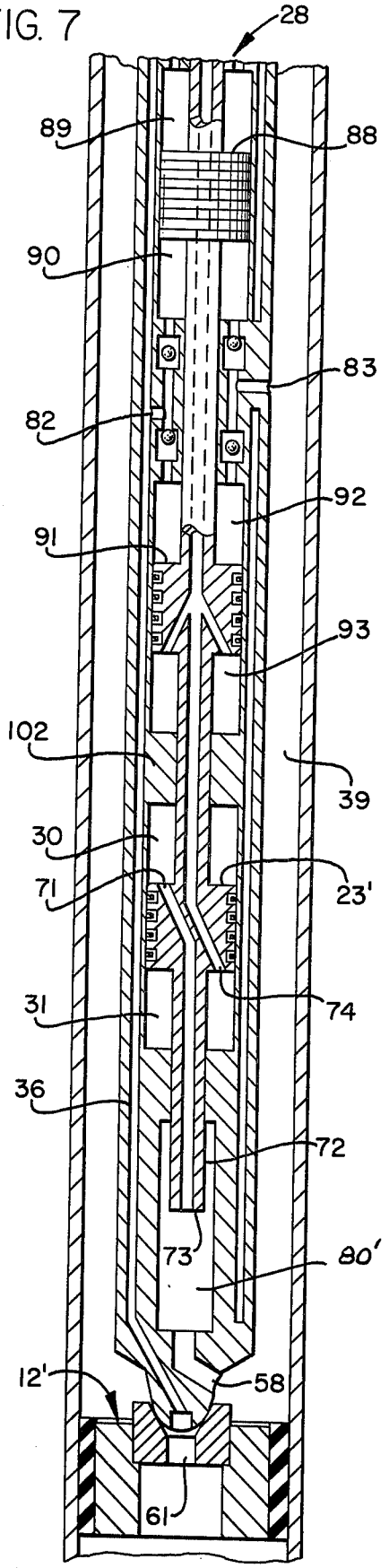

The embodiment of the invention seen disclosed in FIGS. 6 and 7 includes a multiple stage, double-acting pump having at least five pistons. In the specific embodiment of FIG. 6, the engine control valve 15, uppermost piston 25, production valve assembly 28, and lowermost piston 30 are arranged respective to one another in a manner similar to the foregoing figures. Power fluid flows from the engine control valve, along passageway 33, and into chamber 26 in the same before described manner. Longitudinal fluid passageway 77 is formed within the pump housing and conducts power fluid to an intake port 78, while the hollow control rod 24 conducts power fluid and spent power fluid down to and from the terminal end 79 of the balance tube so that the balance chamber 80 is always subjected to a considerable hydrostatic head.

Production valve assembly 81 is provided with a formation fluid inlet port 82 and a produced fluid outlet port 83. Port 84 connects chamber 27 with the production annulus, thereby continually subjecting the lower face of uppermost piston 25 to the entire hydrostatic head of the produced fluid.

Piston 85 divides its cylinder into an upper chamber 86 and a lower chamber 87. Piston 88 divides its cylinder into an upper chamber 89 and a lower chamber 90. Piston 91 divides its cylinder into an upper chamber 92 and a lower chamber 93. Port 94 is connected to chamber 29' so that the upper face of piston 30 is always subjected to the hydrostatic head of the system.

Lower balance tube 95 provides a source of power fluid for the before mentioned balance chamber 80. The pistons are connected together by connecting rod lengths 96, 97, 98, 99, 100, and 101. The hollow rod provides a source of power fluid which flows along the longitudinal axial counterbore of the entire downhole pump apparatus, commencing at 23 and terminating at 80.

In the pump assembly illustrated in FIG. 7, the lower balance tube 72 eliminates the necessity of forming an exhaust port in the manner seen illustrated at 94 in FIG. 6. This is a very desirable attribute to the invention because it conserves room by eliminating the interconnecting passageways. Hence, where deemed desirable, the balance tube 72 and chamber 80' can be eliminated in the larger pumps by the formation of the before mentioned passageway 94. This also increases the effective area of the lower face of piston 23' so that greater upthrust is achieved from the power oil in chamber 31.

In FIG. 6, where deemed desirable, the power oil balance tube 95 can likewise be eliminated in accordance with FIG. 2 at 31.

In the modification of FIG. 7, the pump apparatus located above production valve 28 is identical to the disclosure of FIG. 6. Power fluid flow through the hollow connecting rod 96 terminates within chamber 31, while chamber 30 is connected by means of piston passageway 71 to the balance chamber 80', thereby adjusting the lower terminal end 73 of the balance tube 72 to the hydrostatic head of the system.

In the various embodiments of the invention, the pump assembly can be limited to two pistons for single engine and single production pump operation. Double action requires two engine pistons. The use of five spaced-apart pistons provides double-acting double engines and double production ends. This last expedient, of course, requires two engines above and two engines below in order to provide for the double engine capability. Provision can be made for triple engine and triple production pump by the addition of still another upper and lower piston in accordance with the teachings of the invention.

In each of the embodiments of the present invention, privision is made by which a connecting rod which interconnects the various pistons is maintained in compression on both the upstroke and the downstroke. This expedient avoids the tremendous loads exerted by the hydrostatic head on the production pistons. Rod breakage is eliminated by the above arrangement of the engine and production pistons respective to one another and to the various flow passageways formed in the engine.

I claim:

1. A downhole, hydraulically actuated pump assembly for producing a well comprising an elongated pump housing having an upper and a lower end; a plurality of spaced piston cylinders formed within said housing in axial alignment with one another;

a piston reciprocatingly received within each of said piston cylinders, each said piston dividing its corresponding piston cylinder into upper and lower piston chambers;

means forming a control valve assembly within the upper marginal end of said pump housing, means forming a production inlet passageway at the lower end of said pump housing; means forming a power fluid inlet passageway at the upper end of said pump assembly, an upper fluid chamber located between said power fluid inlet and said valve assembly, means forming a rod balance cavity between said production inlet passageway and the lowermost piston chamber;

a hollow control rod reciprocatingly received within and extending from said upper fluid chamber, through said control valve assembly, and to the uppermost of said pistons; a hollow connecting rod interconnecting each of said pistons, a hollow balance tube extending from the lowermost of said pistons and into said rod balance cavity;

the uppermost chambers of two adjacent uppermost piston cylinders and the lowermost chambers of two adjacent lowermost piston cylinders being engine chambers, there being four piston chambers located between said uppermost and lowermost engine chambers, said four piston chambers being production chambers;

means, including a check valve, forming a produced fluid outlet for each of said production chambers; means, including a check valve, forming a flow path from said production inlet into each of said production chambers;

means forming a power fluid flow path from said power fluid inlet to said control valve assembly;

means forming a first flow passageway which extends from said valve assembly, to said upper fluid chamber, through said control rod, through said connecting rod and the pistons connected thereto, and through the lowermost of said lower pistons into said lowermost piston chambers;

means forming a second flow passageway which extends directly from said valve assembly into said uppermost engine chambers;

and means forming a spent power fluid flow path from said valve assembly by which spent power fluid can be exhausted from said upper and said lower engine chambers through said first and second flow passageways; and, means by which reciprocal movement of said hollow control rod causes said control valve assembly to alternately connect said first and second flow passageways to said power fluid inlet passageway and said spent power fluid flow path.

2. The pump assembly of claim 1 wherein a flow port is formed in said housing which directly connects the lower chamber of one of said piston cylinders to the produced fluid so that any hydrostatic head of the produced fluid is always effected upon the lowermost side of the piston in said last said piston cylinders on both the upstroke and the downstroke of the pistons.

3. The apparatus set forth in claim 1 wherein said pump assembly is of the fixed type;

said means forming a flow path from said production inlet into each of said production chambers is a longitudinal flow passageway which extends from said production inlet, up through said housing, across said check valve, and into each of said production chambers;

a first two of said production chambers being located adjacent to one another and mutually sharing a common inlet and outlet port; and a second two of said production chambers being located adjacent to one another and mutually sharing a common inlet and outlet port.

4. The apparatus set forth in claim 3 wherein said first and said second two said production chambers separate said uppermost and lowermost engine chambers from one another.

5. The apparatus set forth in claim 1 wherein said pump assembly includes five pistons, the lower chamber of the uppermost piston chamber and the upper chamber of the lowermost piston chamber being directly connected to produced fluid by flow port means formed in said housing.

6. The apparatus set forth in claim 1 wherein said pump assembly is of the fixed type;

said means forming a flow path from said production inlet into each of said production chambers is a longitudinal flow passageway which extends from said production inlet, up through said housing, across said check valve, and into each of said production chambers;

said pump assembly includes five pistons, the lower chamber of the uppermost piston chamber and the upper chamber of the lowermost piston chamber being directly connected to the produced fluid by flow port means formed in said housing;

a first two of said production chambers being located adjacent to one another and mutually sharing a common inlet and outlet port; and a second two of said production chambers being located adjacent to one another and mutually sharing a common inlet and outlet port.

7. A downhole, hydraulically actuated pump assembly for producing a well comprising an elongated pump housing having an upper and a lower end; spaced, piston cylinders formed within said housing in axial alignment with one another;

a piston reciprocatingly received within each said piston cylinder, each said piston dividing its corresponding piston cylinder into upper and lower chambers, means forming a control valve assembly at the upper marginal end of said pump assembly, means forming a production inlet at the lower end of said pump assembly; means forming a power fluid inlet passageway from a power fluid inlet to said control valve assembly at the upper end of said pump assembly, an upper fluid chamber formed between said power fluid inlet and said valve assembly, means forming a rod balance cavity between said production inlet and the lowermost piston chamber;

a hollow control rod reciprocatingly received within and extending from said upper fluid chamber, through said control valve means, and to the uppermost of said pistons, a hollow connecting rod interconnecting each of said pistons, a hollow balance tube extending from the lowermost of said pistons and into said rod balance cavity;

the uppermost of said upper piston chambers and the lowermost of said lower piston chambers being engine chambers, at least two of the remaining piston chambers being production chambers, and means by which at least a further two of the remaining piston chambers are always directly connected to the produced fluid;

means forming a first power fluid flow path from said control valve assembly to said uppermost of said upper piston chambers to enable the uppermost piston to downstroke the pump assembly;

means forming a second power fluid flow path to said lowermost piston chamber having a flow passageway from said valve assembly, to said upper fluid chamber, through said control rod, through said connecting rod and the pistons connected thereof through the lowermost of said lower pistons and into the lowermost engine chamber to thereby enable the lowermost piston to upstroke the pump apparatus;

means, including outlet check valve means, forming a produced fluid outlet which is connected to each of said production chambers; the last said means includes a produced fluid flow path which extends from one of said upper piston chambers and one of said lower piston chambers wherein the last said upper and lower chambers are adjacent to one another and separated by a inlet check valve means;

means, including said inlet check valve means, forming a flow path from said production inlet and into each of said production chambers through said housing;

means forming a spent power fluid flow path for conducting spent power fluid from said control valve assembly to the produced fluid flow path; and means by which reciprocal movement of said hollow control rod causes said control valve assembly to alternately connect said first and second flow paths to said power fluid inlet passageway and said spent power fluid flow path thereby causing the pistons to reciprocate within the cylinders.

8. The pump assembly of claim 7 wherein a flow port is formed in said housing which directly connects the lower chamber of said uppermost piston chamber and the upper chamber of the lowermost piston chamber to the produced fluid so that any hydrostatic head of the produced fluid is always effected upon the lowermost side of the uppermost piston and the uppermost side of the lowermost said piston.

* * * * *

UNITED STATES PATENT OFFICE

CERTIFICATE OF CORRECTION

PATENT NO. : 4,084,923

DATED : April 18, 1978

INVENTOR(S) : George K. Roeder

It is certified that error appears in the above-identified patent and that said Letters Patent are hereby corrected as shown below:

Cover page, item [63], substitute --Nov. 17-- for "Nov. 7".

Column 6, line 3, substitute --30'-- for "30°".

Column 6, line 13, substitute --herein-- for "therein".

Column 6, line 67, substitute --of-- for "to".

Column 7, line 16, substitute --subjecting-- for "adjusting".

Column 7, line 31, correct spelling of "provision".

Column 9, line 22, insert --piston-- after "lower".

Column 10, line 11, substitute --thereto-- for "thereof".

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*